United States Patent [19]

Radlmann et al.

[11] 4,131,724

[45] Dec. 26, 1978

[54] CROSSLINKED ACRYLONITRILE COPOLYMERS

[75] Inventors: Eduard Radlmann; Ulrich Reinehr, both of Dormagen; Peter Hoffmann, Leverkusen; Dieter Arlt, Cologne; Gunther Nischk, Dormagen, all of Germany

[73] Assignee: Bayer Aktiengesellschaft, Leverkusen, Germany

[21] Appl. No.: 797,818

[22] Filed: May 18, 1977

[30] Foreign Application Priority Data

May 21, 1976 [DE] Fed. Rep. of Germany ..... 2622920

[51] Int. Cl.[2] ..... C07D 85/36; D01D 5/14

[52] U.S. Cl. ..... 526/16; 264/182; 264/206; 264/236; 526/50

[58] Field of Search ..... 264/182, 78, 236, 206; 526/50, 16

[56] References Cited

U.S. PATENT DOCUMENTS

| | | | |
|---|---|---|---|
| 2,543,602 | 2/1951 | Rowland | 526/50 |
| 2,554,959 | 5/1951 | Rowland | 526/50 |
| 3,609,161 | 9/1971 | Dowbenko | 526/16 |
| 3,758,629 | 9/1973 | Thill | 526/16 |

FOREIGN PATENT DOCUMENTS

| | | | |
|---|---|---|---|
| 2012809 | 7/1976 | Fed. Rep. of Germany | 264/182 |

*Primary Examiner*—Jay H. Woo

*Attorney, Agent, or Firm*—Plumley & Tyner

[57] ABSTRACT

The invention relates to a process for the production of crosslinked fibres or filaments by spinning an acrylonitrile copolymer containing at least 20 mVal of carboxyl groups per kg of polymer together with a polyoxazoline in a polar organic solvent and thereafter crosslinking at temperatures of from 120 to 190° C.

The invention also relates to crosslinked acrylonitrile fibres and filaments obtainable by this process.

7 Claims, No Drawings

CROSSLINKED ACRYLONITRILE COPOLYMERS

This invention relates to crosslinked synthetic fibres and filaments of acrylonitrile copolymers, and to a process for their production.

It is known that the favourable textile properties of synthetic fibres of polyacrylonitrile or acrylonitrile copolymers are offset by certain disadvantages, such as inadequate dimensional stability under wet or hot conditions. The consequences of this are unsatisfactory stitch elasticity, poor resistance to washing of iron-in creases and also bagging and creasing of finished articles by hot washing.

The dimensional stability of acrylic fibres can be improved by copolymerising acrylonitrile with N-methylol compounds, followed by crosslinking with acids. Unfortunately, this involves the danger of premature crosslinking during the actual production of the copolymer and during its processing into filaments.

It is known from DT-OS No. 2,012,809 that crosslinked plastics materials, which are useful as a basis for lacquers, coatings, adhesives, moulding compositions etc., can be obtained by mixing polyoxazolines with polymers containing carboxyl groups, followed by thermal crosslinking through ester and amide groups.

An object of the present invention is to provide crosslinked synthetic fibres and filaments of acrylonitrile copolymers with improved dimensional stability which may be produced by a simple heat treatment at a certain stage of the aftertreatment process during the processing cycle by which the fibres are formed.

It has now been found that acrylic fibres with excellent dimensional stability such as, for example, hot-wet properties and dyeability, can be obtained without any undesirable crosslinking phenomena during the production process, providing an acrylonitrile copolymer containing carboxyl groups is mixed with a polyoxazoline in a suitable solvent, the resulting mixture is spun by a known dry or wet spinning process and the resulting filaments are converted by heat treatment into a crosslinked, insoluble form. It must be regarded as surprising and unforeseeable that the components do not undergo any crosslinking during processing into fibres, i.e. during heating of the polymerpolyoxazoline mixture, for example to 100° C, or during dry spinning. Such crosslinking would have a serious effect upon the spinnability of the fibres.

Accordingly, the present invention relates to a process for the production of crosslinked acrylonitrile copolymer filaments or fibres, which comprises dissolving an acrylonitrile copolymer containing at least 20 mVal of carboxyl groups per kg of polymer together with at least one polyoxazoline, in a polar organic solvent at a temperature of from 20 to 120° C, the molar ratio of carboxyl groups to oxazoline groups amounting to at least 1:1, the spinning the resulting solution into filaments by a wet or dry spinning process and effecting crosslinking during drying of the filaments at a temperature of from 120 to 190° C.

The invention also relates to crosslinked filaments and fibres obtainable by this process.

The molar ratio of carboxyl groups to oxazoline groups should amount to at least 1:1. In other words, carboxyl groups and oxazoline groups are present in equal molar quantities. However, the ratio of carboxyl groups to oxazoline groups may even be greater, for example about 2:1, 3:1 or 4:1, depending upon the degree of crosslinking required. An even greater ratio, for example 8:1 or 10:1 is, of course, also possible in individual cases.

The acrylonitrile copolymers containing carboxyl groups are obtained in known manner by copolymerising acrylonitrile or acrylonitrile in combination with other polymerisable vinyl or acrylic monomers with comonomers containing carboxyl groups such as, for example, acrylic acid, methacrylic acid, itaconic acid, undecylenic acid or compounds of the general formula:

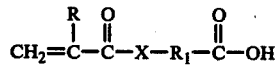

in which R represents a hydrogen atom or methyl radical,

X represents —O— or —NH— and $R_1$ represents an alkylene radical with preferably 1 to 10 carbon atoms or a phenylene radical.

The following comonomers containing carboxyl groups which correspond to the above general formula are preferred:

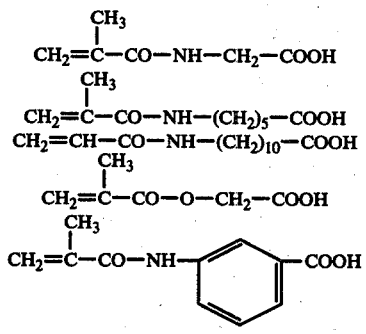

For dyeing with basic or acid dyes, the copolymers may contain the necessary quantities of comonomers containing sulphonate groups or nitrogen atoms, such as for example methallyl sulphonate or N,N-dialkylaminoethyl acrylates, in co-polymerised form or may in addition even be flameproofed, for example by copolymerised halogen-containing monomers, such as vinyl chloride or vinylidene chloride.

Preferred polyoxazolines for the process according to the invention are compounds corresponding to the general formula:

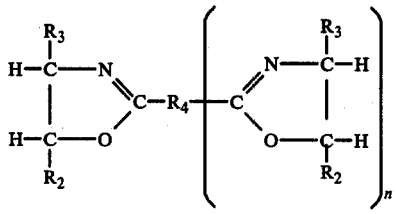

in which $R_2$ and $R_3$, which may be the same or different, represent hydrogen, an alkyl radical with 1 to 8 carbon atoms, preferably a methyl radical, or an aryl radical with 6 to 12 carbon atoms, $R_4$ represents a polyfunctional, more especially difunctional, alkylene radical with 1 to 20 carbon atoms and preferably with 1 to 12 carbon atoms, or an arylene radical with 6 to 12 carbon atoms, and n is a number from 1 to 3.

The following oxazolines, for example, have proved to be particularly suitable:

1,2-; 1,3- and 1,4-bis-(Δ 2-oxazolin-2-yl)-benzene, 1,2-;
1,3- and 1,4-bis-(Δ 2,4-methyloxazolin-2-yl)-benzene, 1,2;
1,3- and 1,4-bis-(Δ 2,5-methyloxazolin-2-yl)-benzene, 1,2;
1,3- and 1,4-bis-(Δ 2,5-ethyloxazolin-2-yl)-benzene, 1,2,4-tris-(Δ 2-oxazolin-2-yl)-benzene, 1,2-bis-(Δ 2-oxazolin-2-yl)-ethane, 1,4-bis(Δ 2-oxazolin-2-yl)-butane, 1,10-bis-(Δ 2-oxazolin-2-yl)-decane.

Suitable polar solvents are the solvents normally used for spinning acrylonitrile polymers such as, for example, dimethyl formamide, dimethyl acetamide, dimethyl sulphoxide or N-methyl pyrrolidone in which the polyoxazolines are also adequately soluble.

Solutions such as these are spun into filaments by conventional wet or dry spinning processes. The spun filaments are collected on bobbins and doubled into tows. The tow is then drawn in boiling water and washed, provided with an antistatic preparation and crosslinked and dried in the absence of tension in a screen drum dryer at temperatures of from 120 to 190° C and preferably at temperatures of from 150 to 180° C. The residence time in the dryer is governed by the crosslinking temperature selected and generally amounts to a few minutes. After this crosslinking and drying operation, the tow is cut into fibres.

Surprisingly, no premature crosslinking is observed either during preparation of the crosslinkable polymer solution at temperatures of up to 100° C or during dry spinning at duct temperatures of up to 160° C. In every case, crosslinking can be initiated at a certain stage of the aftertreatment process, namely during drying.

The polymer chains are thermally crosslinked by reaction of the carboxyl group with the oxazoline rings to form ester and amide structures:

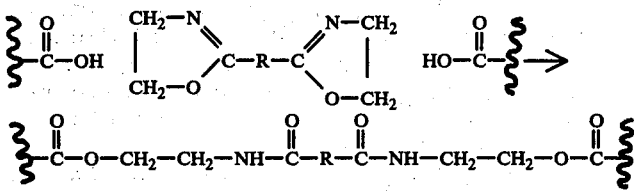

The crosslinked polymers are insoluble in solvents.

The new filaments and fibres according to the invention have excellent dimensional stability under hot or wet conditions, in addition to the well known favourable properties of fibres, such as tensile strength and dyeability.

The invention is further illustrated but not intended to be limited by the following Examples in which the percentages and parts quoted are by weight.

EXAMPLE 1

15 parts of an acrylonitrile/acrylic acid copolymer containing 555 mVal of carboxyl groups per kg of polymer (4.0% by weight of acrylic acid), together with 0.899 part of 1,4-bis-(Δ 2-oxazolin-2-yl)-benzene, are dissolved in dimethyl formamide at 80° C to form a 28% by weight solution. The solution is filtered and dry spun by a conventional method at a duct temperature of 160° C. The solution has a viscosity of 88 dropped-ball seconds (for determining viscosity by the dropped ball method, see K. Jost, Rheologica Acta, Vol. 1, No. 2-3 (1958), page 302). The spun filaments are collected on bobbins and doubled to form a tow. The tow is then drawn in a ratio of 1:3.6 in boiling water and washed in boiling water for 3 minutes under light tension. An antistatic preparation is then applied, followed by drying for 10 minutes at 165° C in a screen drum dryer with 20% permitted shrinkage, the heat effect initiating the crosslinking reaction. The tow is then cut into fibres with a staple length of 60 mm. The individual fibres have an individual denier of 3.3 dtex and are insoluble in dimethyl formamide, even after 1 hour at 130° C. Under a melting point microscope the fibres do not show any deformation up to 350° C. The fibres have a density of 1.187 g/cc which they retain after treatment for 15 minutes in boiling water. The fibres can be deeply dyed with a blue dye of the following constitution:

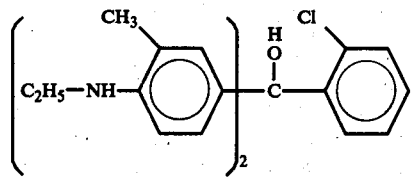

and do not show any significant difference when visually compared with a standard commercial-grade acrylic fibre containing a dye-receptive additive (composition: 94% by weight of acrylonitrile, 5% by weight of methyl acrylate, 1% by weight of sodium methallyl sulphonate).

Important fibre properties are compared in Table I below with those of a standard commercial-grade acrylic fibre.

Table 1

| Fibre properties | Crosslinked sample | Comparison |
|---|---|---|
| Strength [p/dtex] | 2.30 | 2.61 |
| Elongation [%] | 40 | 48 |
| Tack point [° C] | >280 | 215–220 |
| Degree of swelling + [%] | 1550 | soluble |
| Flexlife test [min] | 1.39 | 5–7 |
| Loop tensile strength [p/dtex] | 1.11 | 1.50 |
| Loop elongation at break [%] | 14 | 16 |

+ Degree of swelling = increase in weight after 2 hours at 50° C in DMF.

Table II below shows the values for tensile strength and elongation at break in dependence upon temperature and the corresponding values after the fibres have been washed for 1 minute at 90° C in comparison with the values of a standard commercial-grade acrylic fibre.

Table II

| Temperature [° C] | Strength [p/dtex] | Elongation [%] |
|---|---|---|
| 20 | 2.30 (2.61)+ | 40 (48)+ |
| 50 | 1.85 (0.91) | 49 (62) |
| 90 | 0.80 (0.33) | 78 (> 200) |
| 20 after washing at 90° | 2.01 (2.54) | 42 (60) |

+the values in brackets apply to a standard commercial-grade acrylic fibre.

As can be seen from Tables I and II, the force required to induce "flow" in the fibres according to the invention is considerably greater than in the case of standard commercial-grade types. The fibres have higher "dimensional stability".

EXAMPLE 2

20 parts of an acrylonitrile/vinylidene chloride/acrylic acid copolymer consisting of 58.1% by weight of acrylonitrile, 38.2% by weight of vinylidine chloride and 3.7% by weight of itaconic acid (569 mVal of carboxyl groups per kg) and having a viscosity of 81.5 dropped ball seconds, together with 1.263 parts of 1,4-bis-(Δ 2-oxazolin-2-yl)-cyclohexane, are dissolved in dimethyl formamide at 80° C to form a 28% solution. The solution is then filtered and further processed as in Example 1 to form fibres with an individual denier of 3.3 dtex. The only difference from the procedure of Example 1 is that the filaments are crosslinked and dried for 8 minutes at 170° C in the screen drum dryer. Under a melting point microscope, these fibres also do not show any signs of deformation up to 350° C and may also be dyed as deeply as a non-crosslinked comparison material (composition: 58.6% of acrylonitrile, 38.5% of vinylidene chloride and 2.9% of sodium methallyl sulphonate) with a blue dye of the following constitution:

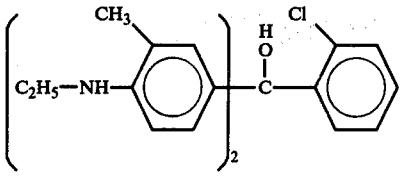

Table III below shows the most important textile data of the crosslinked fibres in relation to the comparison material.

Table III

| Fibre properties | Crosslinked sample | Comparison |
|---|---|---|
| Strength [p/dtex] | 2.72 | 2.52 |
| Elongation [%] | 47 | 57 |
| Tack point [° C] | >280 | 225–230 |
| Degree of swelling +[%] | 1610 | soluble |
| Flexlife test [min] | 1.25 | 4–6 |
| Loop tensile stength [p/dtex] | 0.76 | 0.85 |
| Loop elongation at break [%] | 17 | 20 |

+Degree of swelling = increase in weight after 2 hours at 50° C in DMF

Measurement of the values for elongation at break and tensile strength in dependence upon temperature and after washing for 1 minute at 90° C, clearly shows the reduced tendency of the crosslinked fibres towards "flow", i.e. the crosslinked fibres have greater "dimensional stability" than uncrosslinked comparison material (cf. Table IV).

Table IV

| Temperature [° C] | Strength [p/dtex] | Elongation [%] |
|---|---|---|
| 20 | 2.72 (2.52)+ | 47 (57)+ |
| 50 | 2.28 (1.05) | 52 (73) |
| 90 | 1.43 (0.29) | 81 (>200) |
| 20 after washing at 90° C | 2.14 (2.45) | 49 (71) |

+Values of the comparison fibres

EXAMPLE 3

20 parts of an acrylonitrile/N-methacrylamide amino caproic acid copolymer containing 225 mVal of carboxyl groups per kg (4.5% of N-methacrylamide amino caproic acid), together with 0.473 part of 1,10-bis-(Δ 2-oxazolin-2-yl)-decane, are dissolved in dimethyl formamide at 80° C to form a 25% by weight solution. After filtration, the solution thus obtained is spun by a known wet-spinning process. The tow is drawn in a ratio of 1:3.6 in boiling water and then washed under light tension in boiling water. Following the application of an antistatic preparation, the tow is crosslinked and dried in a dryer for 10 minutes at 165° C with 15% permitted shrinkage. The fibres with an individual denier of 3.3 dtex, cut to a staple length of 60 mm, are insoluble in DMF at 130° C and, under a melting point microscope, do not show any deformation up to 350° C. The fibres can be deeply dyed with the basic blue dye mentioned in Example 1 and show the textile data summarised in Table V below:

Table V

| Fibre properties | Crosslinked sample | Comparison |
|---|---|---|
| Strength [p/dtex] | 2.26 | 2.95 |
| Elongation [%] | 34 | 39 |
| Tack point [° C] | >280 | 215–220 |
| Degree of swelling +[%] | 1480 | soluble |
| Flexlife test [min] | 1.18 | 3–5 |
| Loop tensile strength [p/dtex] | 1.25 | 1.55 |
| Loop elongation at break [%] | 12 | 15 |

+*Degree of swelling = increase in weight after 2 hours at 50° C in DMF*

As in Examples 1 and 2, the crosslinked fibres according to the invention of Example 3 also show less "flow" and greater "dimensional stability" than corresponding wet spun polyacrylonitrile fibres (composition: 94% by weight of acrylonitrile, 5% by weight of methyl acrylate, 1% by weight of sodium methallyl sulphonate), as shown in Table VI:

Table IV

| Temperature [° C] | Strength [p/dtex] | Elongation [%] |
|---|---|---|
| 20 | 2.26 (2.95)+ | 34 (39)+ |
| 50 | 2.12 (1.43) | 46 (80) |
| 90 | 1.14 (0.40) | 79 (>200) |
| 20 after washing | 2.03 (2.38) | 33 (45) |

Table IV-continued

| Temperature [° C] | Strength [p/dtex] | Elongation [%] |
|---|---|---|
| at 90° C | | |

+Values of the comparison fibres

What is claimed is:

1. A process for the production of crosslinked acrylonitrile copolymer filaments or fibres, which comprises dissolving an acrylonitrile copolymer containing at least 20 mVal of carboxyl groups per kg of polymer together with at least one polyoxazoline, in a polar organic solvent at a temperature of from 20 to 120° C, the molar ratio of carboxyl groups to oxazoline groups amounting to at least 1:1, then spinning the resulting solution into filaments by a wet or dry spinning process and effecting crosslinking during drying of the filaments at a temperature of from 120 to 190° C.

2. The process of claim 1, wherein said acrylonitrile copolymer containing carboxyl groups is a copolymer of acrylonitrile with a member selected from the group consisting of acrylic acid, methacrylic acid, itaconic acid, undecylenic acid and a compound corresponding to the general formula:

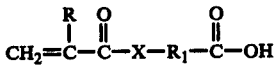

in which

R represents hydrogen or a methyl radical

X represents —O— or —NH—, and $R_1$ represents an alkylene or phenylene radical.

3. The process of claim 1, wherein said polyoxazoline corresponds to the general formula:

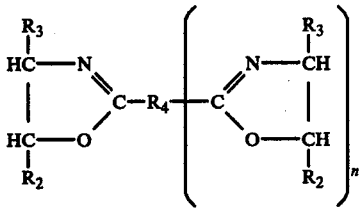

in which $R_2$ and $R_3$, which may be the same or different, represent hydrogen, an alkyl radical with 1 to 8 carbon atoms or an aryl radical with 6 to 12 carbon atoms, $R_4$ represents a polyfunctional alkylene radical with 1 to 20 carbon atoms or an arylene radical with 6 to 12 carbon atoms, and n is an integer from 1 to 3.

4. The process of claim 1, wherein said acrylonitrile copolymer contains polymerized acrylonitrile as the predominant monomer.

5. The process of claim 1, wherein said acrylonitrile copolymer contains at least 58.1% by weight of acrylonitrile.

6. The process of claim 1 wherein spinning is accomplished by dry spinning.

7. A crosslinked filament or fibre of an acrylonitrile copolymer containing crosslinks between the polymer chains comprising structural elements of the general formula:

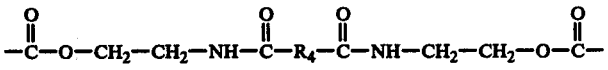

in which $R_4$ is as defined in claim 3.

* * * * *